US008123928B2

(12) United States Patent
Cayouette et al.

(10) Patent No.: US 8,123,928 B2
(45) Date of Patent: Feb. 28, 2012

(54) SHUT-DOWN AND START-UP PROCEDURES OF AN ELECTROLYTIC CELL

(75) Inventors: Robert Cayouette, Ville Saguenay (CA); Martin Bouchard, Saint-Nazaire Lac St-Jean (CA); Jacques Fortin, Saint-Nazaire (CA)

(73) Assignee: Rio Tinto Alcan International Limited, Montreal (CA)

( * ) Notice: Subject to any disclaimer, the term of this patent is extended or adjusted under 35 U.S.C. 154(b) by 269 days.

(21) Appl. No.: 12/645,197

(22) Filed: Dec. 22, 2009

(65) Prior Publication Data

US 2011/0147226 A1 Jun. 23, 2011

(51) Int. Cl.
*C25C 3/20* (2006.01)
*C25C 3/06* (2006.01)

(52) U.S. Cl. ..... 205/375; 205/372; 205/378; 205/389; 205/390; 205/392; 204/243.1; 204/245; 204/247.4

(58) Field of Classification Search ..... 205/372, 205/375, 378, 389, 390, 392; 204/243.1, 204/245, 247.4
See application file for complete search history.

(56) References Cited

U.S. PATENT DOCUMENTS

| | | | | |
|---|---|---|---|---|
| 4,230,540 | A | 10/1980 | Archer et al. | |
| 6,338,785 | B1 * | 1/2002 | de Nora et al. | 205/390 |
| 7,527,715 | B2 | 5/2009 | Fiot et al. | |
| 2004/0089539 | A1 * | 5/2004 | Nora et al. | 204/290.01 |
| 2007/0284259 | A1 * | 12/2007 | MacLeod et al. | 205/390 |

FOREIGN PATENT DOCUMENTS

| | | |
|---|---|---|
| EP | 618313 | 5/1994 |
| GB | 2111082 | 6/1983 |

OTHER PUBLICATIONS

International Search Report from PCT Application No. PCT/CA2010/001971, mailed Feb. 24, 2011.
Welch B.J. & Grjotheim K., "Considerations of the Impact Regular Shutdown has on the Operation of Aluminium Smelters", Light Metals (1988) 613-616.
Agrawal U.B., Upadhyay G.D. & Deoras C.W., "Restart of 100kA VSS Potlines after Long Shutdown", Light Metals (2002).
Vasquez, J., Primera R., Hipolite C. & Kedzo J., "Long Period Power Failure in the 230 kA Aluminium Pot Line AT Venalum", Light Metals (1992) 363-368.
Tremblay L. & Leblanc G., "Eight-and-a-half-hour power failure and subsequent restart of the 180kA prebaked aluminum potline in Baie-Comeau", Production and Electrolysis of Light Metals, CIM (1989) 29-37.
Minifie K.C. & Sykes E.S., "Shutdown and Restart of Kitimat Smelter", TMS Paper No. 72-21, Light Metals (1972) 37-51.
Driscoll K.J., "The Economics of Shutting and Restarting Primary Aluminium Smelting Capacity", Light Metals (1996) 305-312.

* cited by examiner

*Primary Examiner* — Bruce Bell
(74) *Attorney, Agent, or Firm* — Banner & Witcoff, Ltd.

(57) ABSTRACT

A process for shutting down an operating electrolytic cell for the production of aluminium is described. The process includes: lowering anodes until a lower portion of the anodes is immersed in an aluminium layer; allowing the aluminium layer and an electrolyte bath to cool down with the lower portion of the anodes immersed in the aluminium layer; determining if the electrolyte bath is solidified, and if the electrolyte bath is solidified, raising the anodes before solidification of the aluminium layer to create a space between the solidified electrolyte bath and the anodes and the aluminium layer.

26 Claims, 6 Drawing Sheets

SHUT-DOWN AND START-UP PROCEDURES OF AN ELECTROLYTIC CELL

FIELD OF THE INVENTION

The technical field relates to controlled shut-down and start-up procedures of an aluminium smelter and, more particularly, to the shut-down procedure of an electrolytic cell without anode removal.

BACKGROUND

An aluminium smelter may be shut-down for routine re-lining of the electrolytic cell over a period of five to eight years. During maintenance shut-down for re-lining, the maximum metal and often the bath are siphoned from a cell and the cell is allowed to cool down. The anodes are usually raised after the cell power is shut off to reduce sodium contamination. The frozen electrolyte, alumina cover, refractory lining, and cathode are subsequently dug out of the cell using tools such as jackhammers, and any of the anodes which can be recovered are removed for cleaning, a labour intensive process.

If a smelter is shut down as a result of labour conflicts, power constraints or economic downturns, it is generally desirable to shut down the electrolytic cell while keeping the cell intact unless the cell was already scheduled for re-lining. In unexpected temporary shut-downs, for example, because of electrical failure or accident, it may be possible to maintain an electrolytic cell in a "sleeping mode" with low energy applied in the cell and by lowering the anodes until they are submerged in liquid metal. Upon start-up, sufficient heat may be generated by raising the anodes close to the metal surface in order to gradually heat up the metal and sufficiently enough to pour liquid bath into the cell. Such a procedure may be dangerous, requires constant supervision and is not cost-effective if the shut-down is of prolonged duration because of the energy consumption during stoppage and the difficulty to raise the anode beam when the metal temperature is lower than 800° C.

The normal restart procedure after a complete classical stoppage requires that the electrolyte, the anodes, and alumina cover be removed in order to expose the frozen metal surface. About 20% of old anodes are generally scrapped and the good ones are cleaned and put back in the cell to be used for restart. After pre-heating the cathode to minimize the risk of explosions from moisture, molten electrolyte from so-called "donor cells" is added to cover the cathode to a depth sufficient to submerge the anodes in electrolyte. As power builds up, the anodes are raised away from the cathode to a predetermined anode-cathode distance.

BRIEF SUMMARY

It is therefore an aim in certain embodiments of the present invention to address the above mentioned issues and to provide controlled shut-down and start-up procedures for electrolytic cells which reestablish normal operations relatively quickly and with relatively low associated costs.

According to a general aspect, there is provided a process for shutting down an operating electrolytic cell for the production of aluminium, the electrolytic cell having a cathode block, a depth of molten aluminium layer covering the cathode block, and a depth of molten electrolytic bath covering the molten aluminium layer, a plurality of anodes disposed for vertical movement into and out of the electrolytic cell to vary an anode-cathode distance separating a bottom surface of the anodes from a top surface of the molten aluminium layer, electrolysis electric power being applied to the anodes to reduce alumina fed to the electrolytic cell and produce aluminium metal on the cathode block. The process includes a) gradually moving downwardly the anodes from an operating position where the bottom surfaces of the anodes are immersed in the electrolytic bath to a cooling position where the bottom surfaces are immersed in the molten aluminium layer; b) allowing the electrolytic cell to cool and moving up and down the anodes periodically on a short distance to break a peripheral crust of solidifying electrolytic bath forming at a periphery of the electrolytic cell during the cooling step; c) after the electrolytic bath is completely solidified into a cohesive mass, raising the anodes to create a space between a bottom surface of the solidified electrolytic bath and a top surface of molten aluminium layer; and d) allowing the electrolytic cell to cool until the aluminium layer solidifies.

In an embodiment, the electrolysis electric power to the electrolytic cell is cut off after step a). In another embodiment, step a) is performed within one hour of cutting off power to the electrolytic cell.

In an embodiment, in step a), the anodes are moved downwardly on a distance between 6 and 7 cm over a period of fifteen to twenty minutes.

In an embodiment, at least one pouring hole is formed and maintained in the solidifying electrolytic bath.

In an embodiment, in step b), the anodes are moved upwardly a height of up to 1.5 cm and downwardly a height of up to 1.5 cm once every hour. In a particular embodiment, the anodes are moved upwardly and downwardly within approximately one to five minutes.

In an embodiment, step c) is performed after the molten aluminium layer has reached a temperature of 825° C.

According to another general aspect, there is provided a process of restarting an electrolytic cell that is shut down as described above. The process for restarting the cell comprises: adding molten electrolytic bath to the electrolytic cell and into the space defined between the solidified electrolytic bath and the solidified aluminium layer; applying electrolysis electric power to the electrolytic cell following the addition of molten electrolytic bath to the electrolytic cell; then, adding additional molten electrolytic bath to the electrolytic cell and simultaneously raising the anodes until the anode-cathode distance is between seventeen and twenty centimeters.

In an embodiment, the additional molten electrolytic bath is superheated above the liquidus temperature of the electrolytic bath before being added to the electrolytic cell.

In an embodiment, the anode-cathode distance is maintained between 17 to 20 cm until the previously solidified aluminium layer metal has completely melted; and then siphoning excess electrolytic bath from the electrolytic cell and restoring the anode-cathode distance to the operating position.

According to another general aspect, there is provided a process for shutting down an operating electrolytic cell for the production of aluminium and having vertically displaceable anodes. The process comprises: lowering the anodes until a bottom surface of the anodes is immersed in an aluminium layer of the electrolytic cell in a molten state; allowing the aluminium layer and an electrolyte bath in a molten state to cool down with the bottom surface of the anodes immersed in the aluminium layer, the electrolyte bath covering the aluminium layer; determining if the electrolyte bath is solidified, if the electrolyte bath is solidified, raising the anodes before solidification of the aluminium layer to create a space between a bottom surface of the solidified electrolyte bath and the bottom surface of the anodes and a top surface of the aluminium layer.

In an embodiment, the cooling down step further comprises periodically moving up and down the anodes to break a peripheral crust of the electrolyte bath at a periphery of the electrolytic cell.

In an embodiment, the bottom surface of the anodes remains immersed in the aluminium layer during the periodically moving up and down step.

In an embodiment, the electrolysis electric power to the electrolytic cell is cut after the anode lowering step. In another embodiment, the anode lowering step is performed within one hour of cutting electrolysis electric power to the electrolytic cell.

In an embodiment, the anode lowering step comprises moving downwardly the anodes along a distance of approximately five to seven centimeters over a period of at least ten minutes.

In an embodiment, wherein the anode raising step is performed after the aluminium layer has reached a temperature below approximately 825° C.

In an embodiment, the determining step further comprises monitoring a temperature of the aluminium layer and wherein the anode raising step is performed after the temperature of the aluminium layer is below approximately 825° C.

In an embodiment, the anode raising step is performed before the aluminium layer reaches approximately 660° C.

According to a further general aspect, there is provided a process for shutting down an operating electrolytic cell for the production of aluminium; the process comprising: moving downwardly anodes of the electrolytic cell from an operating position where bottom surfaces of the anodes are immersed in an electrolytic bath in a molten state to a cooling position where the bottom surfaces of the anodes are immersed in an aluminium layer in a molten state, the aluminium layer being covered by the electrolytic bath; allowing the electrolytic cell to cool and periodically moving up and down the anodes with the bottom surfaces of the anodes remaining in the aluminium layer to break a peripheral crust of the electrolytic bath forming at a periphery of the electrolytic cell; monitoring a state of the electrolytic bath; after the electrolytic bath has completely solidified into a cohesive mass, raising the anodes to create a space between a bottom surface of the electrolytic bath in a solid state and a top surface of the aluminium layer in the molten state; and allowing the electrolytic cell to cool until the aluminium layer solidifies.

In an embodiment, the electrolysis electric power to the electrolytic cell is cut after the anode moving downwardly step. In another embodiment, the anode moving downwardly step is performed within one hour of cutting electrolysis electric power to the electrolytic cell.

In an embodiment, the bottom surface of the anodes is located above the top surface of the aluminium layer after the anode raising step and during the cooling step.

According to a still another general aspect, there is provided a process of restarting an electrolytic cell for the production of aluminium, the electrolytic cell having a solidified aluminium layer, an electrolytic bath solidified around anodes and spaced apart from the aluminium layer by a seven to twelve centimeter anode-cathode distance separating an bottom surface of the anodes from a top surface of the solidified aluminium layer; the process comprising: adding molten electrolytic bath to the electrolytic cell and into a space defined between the solidified electrolytic bath and the solidified aluminium layer; applying electrolysis electric power to the electrolytic cell following addition of molten electrolytic bath to the electrolytic cell; then, adding additional molten electrolytic bath to the electrolytic cell and simultaneously raising the anodes until the anode-cathode distance is between seventeen and twenty centimeters.

In an embodiment, the anode-cathode distance is maintained between 17 to 20 cm until the previously solidified aluminium layer metal has completely melted; and then excess electrolytic bath is siphoned from the electrolytic cell and the anode-cathode distance is restored to an operating position.

BRIEF DESCRIPTION OF THE DRAWINGS

It will be noted that throughout the appended drawings, like features are identified by like reference numerals.

DETAILED DESCRIPTION

Figure 1:
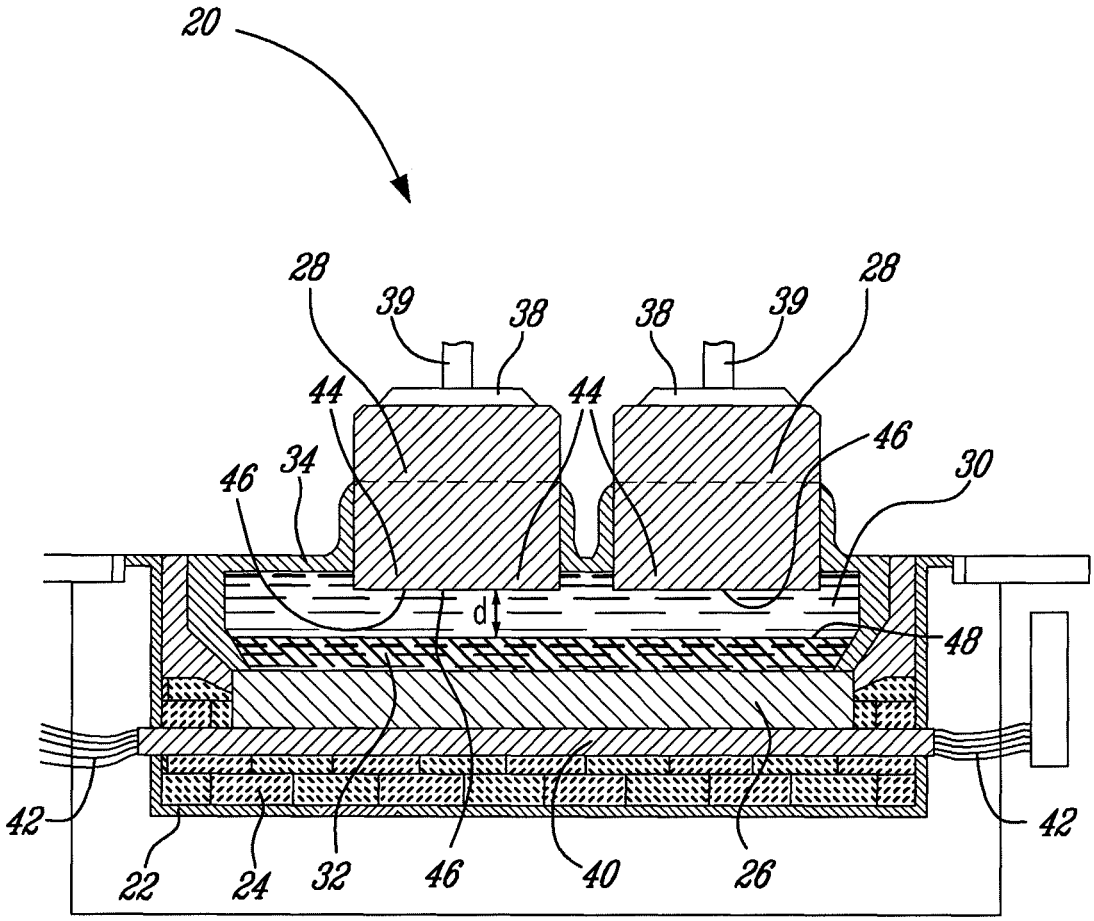
FIG. 1 is a schematic cross-sectional view of an electrolytic cell in normal operation.

Referring to FIG. 1, there is shown an electrolytic cell 20 for aluminium production. The cell 20 has an outer shell 22 containing an internal lining 24 and a cathode block 26 located in a lower section of the cell 20. Anodes 28 are shown with a lower portion 44 immersed in a molten electrolytic bath 30 that lies over a molten aluminium metal layer 32. The molten aluminium layer covers the cathode block 26.

In an embodiment, the outer shell 22 is made of metal such as steel, the internal lining 24 generally includes blocks of refractory material, refractory lining paste and/or solidified bath, the cathode block 26 is a carbothermic cathode block, and the anodes 28 are made of carbonaceous material. The electrolytic bath 30 is cryolite-based and includes dissolved alumina. A thin, solid electrolyte and alumina-based crust 34 usually forms a top layer, covers the electrolytic bath 30, and surrounds the anodes 28. The aluminium layer 32 often will have a depth that varies between twelve to twenty centimeters (12-20 cm) and the electrolytic bath 30 has a depth that typically varies between sixteen to nineteen centimeters (16-19 cm). The depth of the aluminium layer 32 varies over time. It increases as liquid metal accumulates at the bottom of the crucible and it decreases when liquid metal is removed from the cell 20.

The anodes 28 are connected to an anode beam (not shown) through attachment means 38 and an anode frame 39. The anode frames 39 are adapted to lower and raise the anodes 28 within the electrolytic cell 20. In an embodiment, electric power to lower and raise the anodes 28 within the electrolytic cell 20 is independent from the electric power for electrolysis of alumina, i.e. the anode frames 39 are powered separately from the very high voltage power supplied to the electrolysis cell 20. The electrolysis power can be turned off while the electric power for moving the anodes 28 can be functional. The anode frame 39 can thereby be kept free to control the anode position in the cell 20.

An electrolysis electrical current flows through the aluminium electrolytic cell 20. The electrical current enters the cell 20 through the anodes 28 via the anode beam, the anode frame 39, and the attachment means 38, passes through the electrolytic bath 30 and the molten aluminium layer 32. The electrical current then enters the cathode block 26 and is carried out of the cell 20 by cathode bars 40. The cathode bars 40 are typically made of steel and electrical conductors 42 are attached thereto route the electrolysis current.

During cell operation, the electrolytic bath 30 and the molten aluminium layer 32 are contained within a crucible including the internal lining 24 and the cathode block 26.

During normal operation, an inferior portion 44 of the anodes 28 is immersed in the electrolyte bath 30 as shown in FIG. 1, without being in contact with the molten aluminium layer 32. Metal aluminium produced during electrolysis accumulates at the bottom of the crucible and a relatively clear interface is established between the molten aluminium layer 32 and the molten electrolyte bath 30. The anodes 28 are immersed to penetrate into the bath 30 and maintain an approximate anode-cathode distance "d" between the bottom surface 46 of the anodes 28 and the top surface 48 of the aluminium layer 32 of approximately four centimeters (4 cm), i.e. the distance between the bottom surface 46 of the anodes 28 and the interface between the aluminium layer 32 and the electrolyte bath 30. It is appreciated that the anode-cathode distance "d" can range between three to four centimeters (3-4 cm) in alternative embodiments.

Figure 2:
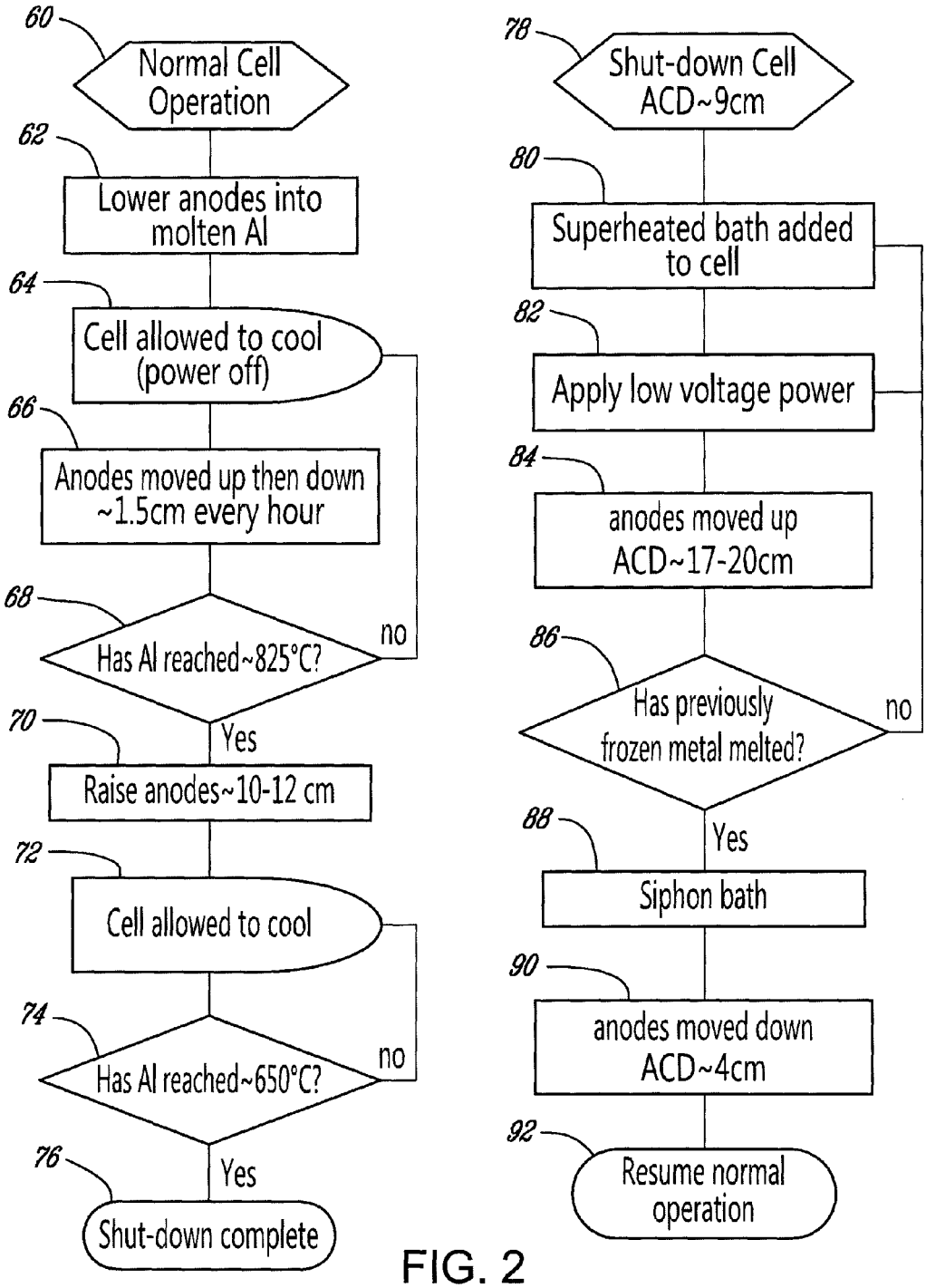
FIG. 2 is a flowchart showing the various steps in shut-down and start-up procedures of the electrolytic cell in accordance with an embodiment and corresponding to the schematic drawings of FIGS. 1, and 3 to 6.

Referring now to FIG. 2, the various steps of one embodiment of a process for shutting down and starting the cell 20 are shown in a flowchart. More particularly, the left flowchart shows the steps for shutting down the cell 20 while the right flowchart shows the steps for starting the cell 20 following the cell shut down.

The cell shut down can be planned or it can be unintended, such as during a power failure. Block 60 represents the cells 20 in normal operation wherein the anodes 28 are immersed to penetrate into the electrolyte bath 30 and maintain an anode-cathode distance "d" of approximately four centimeters (4 cm).

Figure 3:
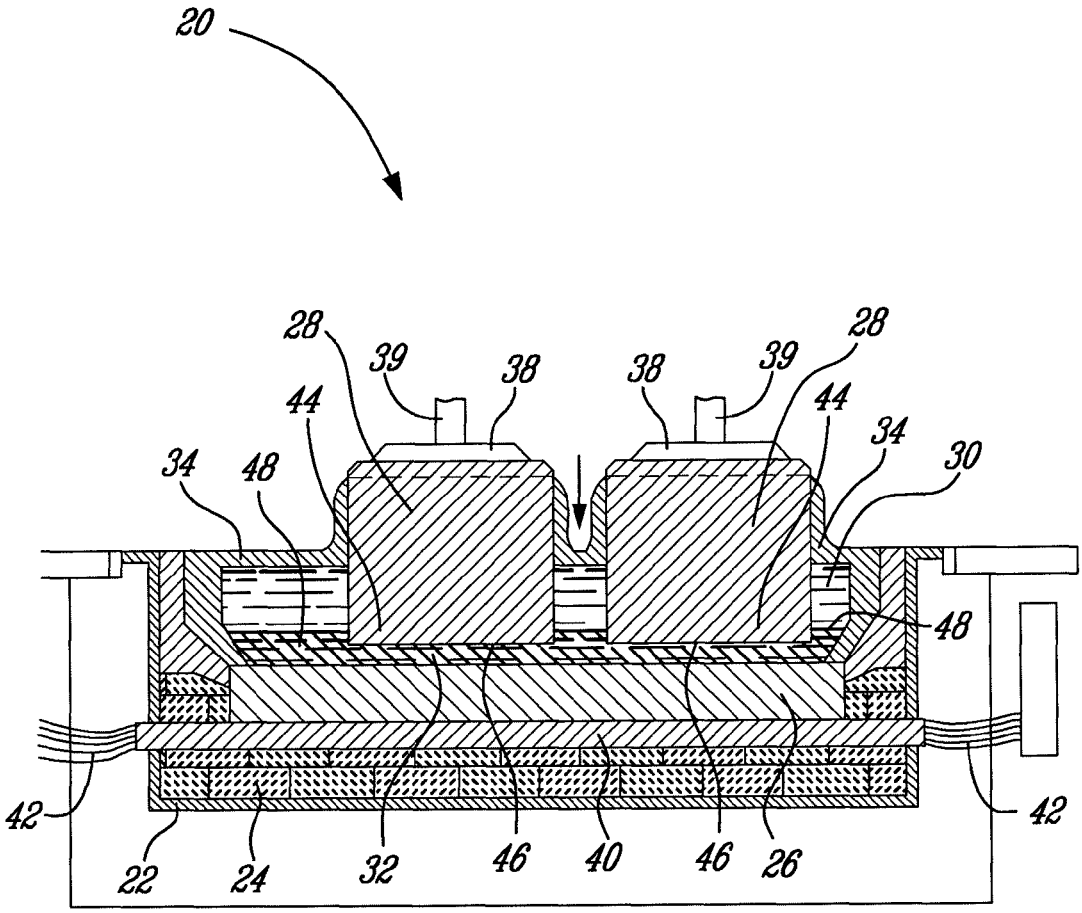
FIG. 3 is a schematic cross-sectional view of the electrolytic cell of FIG. 1 during an initial shut-down phase in accordance with an embodiment.

In preparation for shut-down, the anodes 28 are lowered gradually through the bath 30 so as that their inferior portions 44 are immersed in the aluminium layer 32 as shown in FIG. 3 and represented in block 62. Typically, the anodes 28 will be lowered to a distance of about six (6) cm over a fifteen to twenty minute period. The anodes 28 are gradually lowered to reduce bath spillage. Bath will tend to flow over the crust of the smallest anode butts that are lower than the sidewall. In case of a planned stoppage, a few holes may be made around the smallest butts. The descent of the anodes 28 into liquid metal 32 is controlled at a rate intended to cause any displaced liquid bath 30 to flow over the top crust 34 thereby minimizing any bath spill over the sidewall. The lowering speed is related to the free space observed under the sidewall.

Following the lowering step, the anodes 28 can be partially submerged in aluminium metal by as much as four to nine centimeters (4-9 cm) because the anodes 28 displace aluminium metal 32 and the aluminium metal 32 level increases. Thus, following step 62, the bottom surface 46 of the anodes 28 is located approximately between four to nine centimeters (4-9 cm) below the top surface 48 of the aluminium layer 32, i.e. four to nine centimeters (4-9 cm) below the interface between the aluminium layer 32 and the electrolyte bath 30.

In a planned shut-down, step 62 can be performed while the electrolysis cell power is still on. In a non-intentional shut down, step 62 should be performed as soon as possible while the electrolyte bath 30 and the aluminium metal 32 temperatures are still relatively high. For instance, step 62 could be performed within approximately one hour of the electrolysis cell power being cut off. If step 62 is not performed early enough following the cut off of the electrolysis cell power, the electrolyte bath 30 can become too viscous and the submerged inferior portions 44 of the anodes 28 may entrain electrolytic bath 30 which could interfere with a following start-up procedure, which will be described in more details below. By immersing the anodes 28 in the metal layer 32 while the electrolytic bath 30 is still substantially fluid, a substantially clean anode surface can be submerged in the metal layer 32.

Following step 62, in a planned shut-down, the electrolysis power to the cell 20 is shut off.

Once the power to the cell 20 is shut off, the cell 20 is allowed to cool down as shown in block 64. The electrolytic bath has a higher melting point than aluminium metal. Thus, during the cooling step 64, the electrolytic bath 30 and the metal layer 32 cool down until the entire bath 30 solidifies from the top down forming a cohesive mass. The cooling and solidification process may take up to one day.

Figure 4:
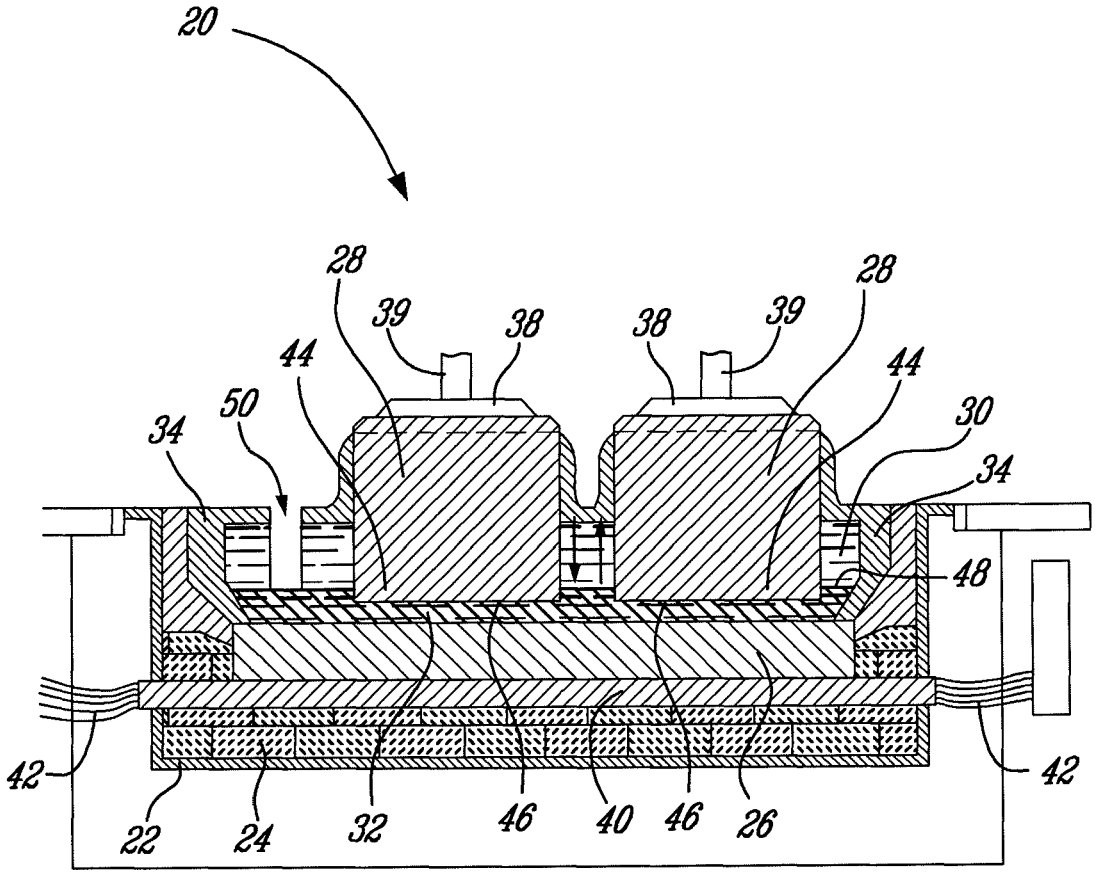
FIG. 4 is a schematic cross-sectional view of the electrolytic cell of FIG. 1 during a shut-down cooling phase in accordance with an embodiment.

During the cooling step shown in FIG. 4., the anodes 28 are moved every hour up to approximately 1.5 cm then down to approximately 1.5 cm, as shown in block 66. It is appreciated that the anodes 28 can be moved upwardly and downwardly to a height of up to about 1.5 cm. For instance, the anodes are moved up and then down every hour. It is appreciated that the anodes 28 can be moved upwardly and downwardly within one to five minutes. As mentioned above, the anode frame 39 is powered separately from the very high voltage power supply to the cell 20 and is thereby kept free to control the anode position in the cell 20. The back and forth (or up and down) movements of the anodes 28 gently break the freezing electrolyte crust forming on the cell perimeter, i.e. cracks are formed in the crust. The up and down movements of the anodes 28 destroy the bond between the electrolyte crust 30 and the internal lining 24 of the cell 20. During the back and forth motion of the anodes 28, the bottom surface 46 of the anodes 28 remains below the top surface 48 of the aluminium layer 32, i.e. below the interface between the aluminium layer 32 and the electrolyte bath 30. The back and forth motion of the anodes 28 is not a vigorous movement and the electrolytic bath 30 still freezes around the anodes 28.

A pouring hole 50 is created and maintained in the freezing electrolytic bath 30 at one end of the cell 20 through which molten bath from donor cells may be added to the cell 20 on start-up. The pouring hole is maintained open during bath cool down with a sufficient width to pour in liquid bath for an eventual start-up. This activity will be explained in more details below with reference to FIG. 6. It is appreciated that a second hole may be created in the freezing electrolytic bath 30 in order to see the liquid bath from the other end of the pot during restart.

During the cooling step, the temperature of the molten metal 32 is monitored, as shown in decision block 68, and when the molten metal has cooled to approximately 825° C., the electrolytic bath 30, which has a melting point of about 900° C., will have completely solidified. It is appreciated that the electrolytic bath 30 can be solidified at a temperature around 825° C. For instance, the temperature in the decision block 68 can range between 800 and 830° C.

Figure 5:
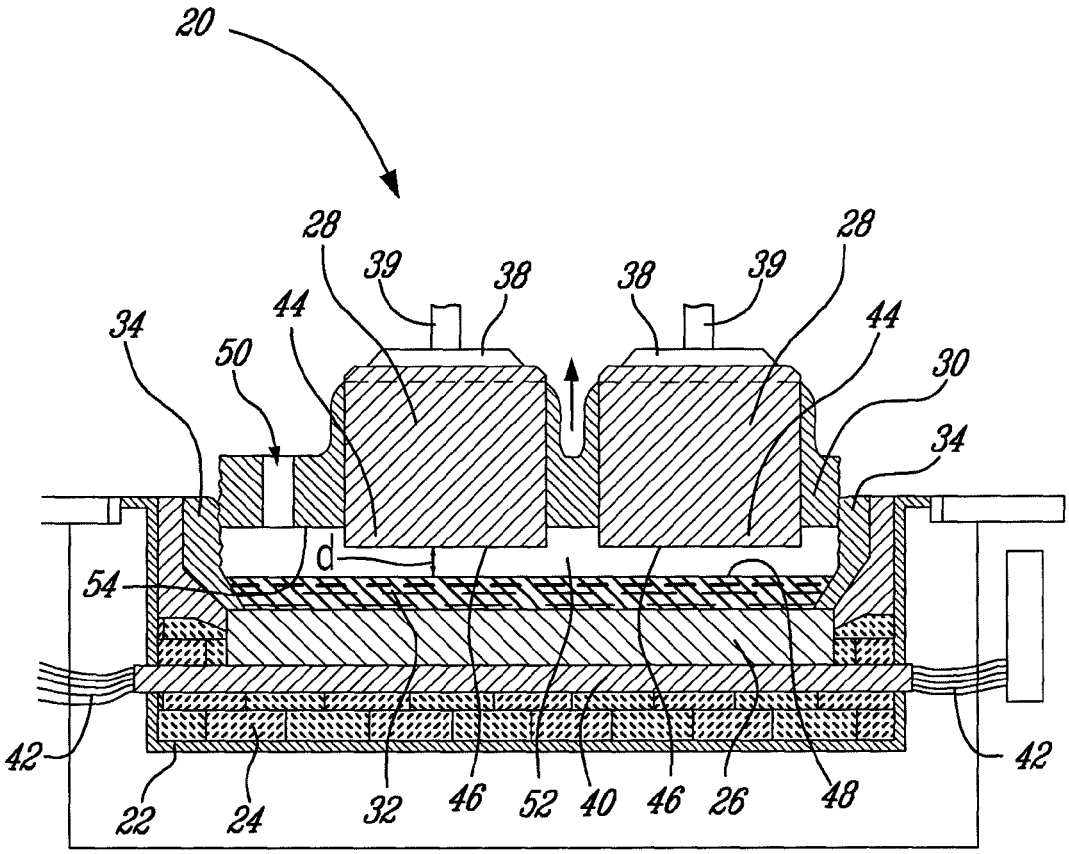
FIG. 5 is a schematic cross-sectional view of the electrolytic cell of FIG. 1 when the electrolytic cell shut-down has been completed in accordance with an embodiment.

Well before the aluminium metal solidifies at about 660° C., the anode frame 39 is lifted to raise the anodes 28, as shown in block 70, by a height of about ten to twelve centimeters (10-12 cm) thereby forming a space 52 that extends from the bottom surface 54 of the frozen electrolytic bath 30 to the top surface 48 of the metal layer 32. Therefore, a space exists between the bottom surface 46 of the cleaned anodes 28 and the top surface 48 of the metal layer 32, as illustrated in FIG. 5.

Because the metal layer 32 is still liquid, the anodes 28 will lift cleanly out of the metal and present a conductive surface for enabling start-up. The top surface 48 of the metal layer 32 will likewise be clean and free of any solid bath because all electrolyte material will freeze as a cohesive mass 30 between the anodes 28. It will also be understood that the metal level will decrease as the anodes 28 are withdrawn thereby increasing the separation between the molten metal 32 level and the frozen bath 30. The bottom surface 46 of the cleaned anodes 28 is spaced apart from the top surface 48 of the metal layer 32.

Finally, the metal 32 is allowed to cool, as shown in block 72, until it too has frozen. Once the metal temperature has reached approximately 660° C., as shown in decision block 74, the aluminium layer 32 is completely frozen and the shut-down is completed, as shown in block 76. For safety reasons, precautions are taken to ensure that there is no water contamination into the cells 20 at any step during the shut-down procedure. During the metal solidification, the distance between the bottom surface 46 of the anodes 28 and the top surface 48 of the metal layer 32 increases due to metal contraction.

Thus, the electrolytic cell 20 is shut-down with the bottom surfaces 46 of anodes 28 located approximately nine centimeters (9 cm) above the frozen aluminium layer 32, as shown in block 78. It is appreciated that the bottom surface 46 of the anodes 28 can be spaced apart from the top surface 48 of the metal layer 32 by a distance ranging approximately between eight to ten centimeters (7-12 cm).

Figure 6:
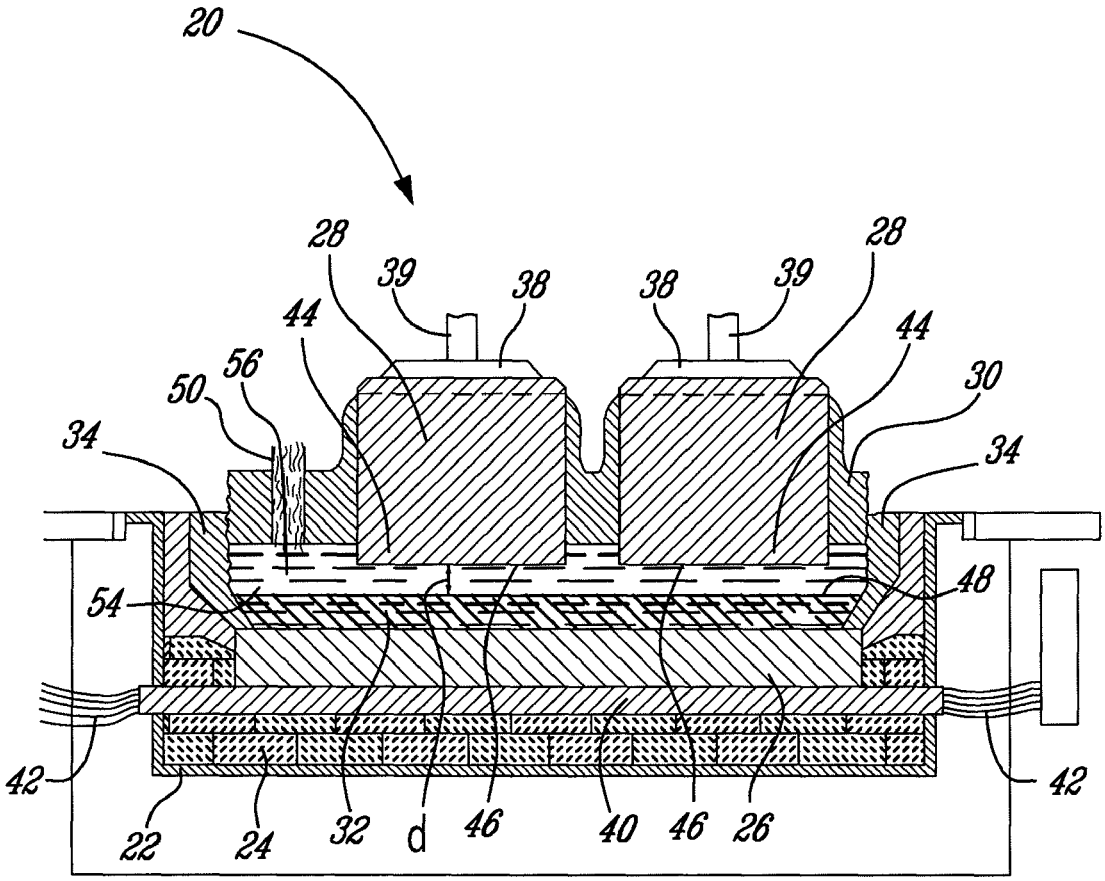
FIG. 6 is a schematic cross-sectional view of the electrolytic cell of FIG. 1 during cell start-up in accordance with an embodiment.

Before start-up, donor cells are heated up to superheat electrolytic bath approximately twenty to forty degrees (20° to 40°) above the liquidus of the electrolytic bath. Superheated liquid bath 56 is poured down the pre-formed pouring hole 50 to fill the space 52 (shown in FIG. 5) of a shut-down cell, as shown in block 80, so as to ensure that the inferior portions of the anodes 28 which extend through the frozen electrolytic bath 30 are completely wetted. The superheated liquid bath 56 is allowed to rise in the pouring hole 50 and up the refractory lining 24 on the perimeter of the cell 20 to a height sufficient to submerge the anodes 28 by seven to ten centimeters (7 to 10 cm) and to fill the space 52 between the top surface 48 of the frozen metal 32 and the frozen bath 30. As mentioned above, the initial anode-cathode distance "d", in the start-up procedure, as shown in FIG. 6 corresponds to the anode-cathode distance during shut-down and is, in a non-limitative embodiment, approximately between seven and twelve centimeters (7 and 12 cm) and, in a particular embodiment, nine centimeters (9 cm).

Then, power is subsequently applied to the cell 20 using as low voltage as possible which, in an embodiment, does not exceed 50 volts, as shown in block 82.

After the electrolysis power is back on, additional liquid bath is poured in the electrolysis cell 20 and the anodes 28 are raised at the same time by keeping a substantially similar immersion until the anode-cathode distance "d" is between seventeen to twenty centimeters (17-20 cm).

Typically, six to twelve donor cells must be preheated to provide sufficient superheated bath 56 to start a new cell 20. While the volume of liquid superheated bath 56 that is required for a start-up will vary considerably, a typical cell 20 may require (ten to twenty) tonnes of liquid superheated bath 56 to build up the depth of the molten electrolyte until the anode-cathode distance "d" reaches seventeen to twenty centimeters (17-20 cm), as shown in block 84. In conventional restart procedures, the anode-cathode distance is typically between seven and twelve centimeters (7 to 12 cm). Increasing the anode-cathode distance for the restart procedure is a safety precaution to avoid projection of the molten metal located at the surface of the cathode outside the cell 20. Metal projections could injure any operators in the vicinity. Before the metal in the cell completely remelts, the feeding of any alumina should be avoided since it could otherwise cause undesirable hard deposits on the frozen metal pad.

As the cell 20 heats up, the previously frozen metal pad 32 becomes molten, as shown in decision block 86, and excess bath can be siphoned, as shown in block 88, for starting up other cells. As the start-up progresses, the anode cathode-distance "d" is restored to approximately three to four centimeters (3 to 4 cm), as shown in block 90, thereby restoring normal operating conditions, as shown in FIG. 1 and block 92.

It will be appreciated that the processes described herein provide a shut-down procedure which allows an electrolytic cell to be started up in a much more efficient, economical, and safe manner. One of the primary reasons for economy is that the time and labour associated with the normal removal and refurbishing of anodes is eliminated. In addition, there is no labour involved in removing any bath from the cell and the metal left in the cell does not require any surface preparation for start-up. Accordingly, because there is less interference, physical damage to the structure of existing cells is limited and the prospects for faster and successful start-ups can be vastly improved. Conveniently, a safer operation procedure can also be provided, resulting in a significant reduction of the costs associated with cell start-ups.

The embodiments of the invention described above are intended to be exemplary only. For instance, it is appreciated that the electrolyte bath and aluminium layer temperatures and the anode-cathode distances for the various steps can vary from the ones described above. The scope of the invention is therefore intended to be limited solely by the scope of the appended claims.

The invention claimed is:

1. A process for shutting down an operating electrolytic cell for the production of aluminium, the electrolytic cell having a cathode block, a depth of molten aluminium layer covering the cathode block, and a depth of molten electrolytic bath covering the molten aluminium layer, a plurality of anodes disposed for vertical movement into and out of the electrolytic cell to vary an anode-cathode distance separating a bottom surface of the anodes from a top surface of the molten aluminium layer, electrolysis electric power being applied to the anodes to reduce alumina fed to the electrolytic cell and produce aluminium metal on the cathode block, the process comprising:

a) gradually moving downwardly the anodes from an operating position where the bottom surfaces of the anodes are immersed in the electrolytic bath to a cooling position where the bottom surfaces are immersed in the molten aluminium layer;

b) allowing the electrolytic cell to cool and moving up and down the anodes periodically on a short distance to break a peripheral crust of solidifying electrolytic bath forming at a periphery of the electrolytic cell during the cooling step;

c) after the electrolytic bath is completely solidified into a cohesive mass, raising the anodes to create a space between a bottom surface of the solidified electrolytic bath and a top surface of molten aluminium layer; and d) allowing the electrolytic cell to cool until the aluminium layer solidifies.

2. A process according to claim 1, in which the electrolysis electric power to the electrolytic cell is cut off after step a).

3. A process according to claim 1, in which step a) is performed within one hour of cutting off power to the electrolytic cell.

4. A process according to claim 1, wherein, in step a), the anodes are moved downwardly on a distance between 6 and 7 cm over a period of fifteen to twenty minutes.

5. A process according to claim 1, further comprising forming and maintaining at least one pouring hole in the solidifying electrolytic bath.

6. A process according to claim 1, wherein, in step b), the anodes are moved upwardly a height of up to 1.5 cm and downwardly a height of up to 1.5 cm once every hour.

7. A process according to claim 6, wherein the anodes are moved upwardly and downwardly within approximately one to five minutes.

8. A process according to claim 1 in which step c) is performed after the molten aluminium layer has reached a temperature of 825° C.

9. A process of restarting an electrolytic cell that is shut down in accordance with claim 1, further comprising adding molten electrolytic bath to the electrolytic cell and into the space defined between the solidified electrolytic bath and the solidified aluminium layer;

applying electrolysis electric power to the electrolytic cell following the addition of molten electrolytic bath to the electrolytic cell;

then, adding additional molten electrolytic bath to the electrolytic cell and simultaneously raising the anodes until the anode-cathode distance is between seventeen and twenty centimeters.

10. A process according to claim 9, in which the additional molten electrolytic bath is superheated above the liquidus temperature of the electrolytic bath before being added to the electrolytic cell.

11. A process according to claim 9, further comprising maintaining the anode-cathode distance between 17 to 20 cm until the previously solidified aluminium layer metal has completely melted; and then siphoning excess electrolytic bath from the electrolytic cell and restoring the anode-cathode distance to the operating position.

12. A process for shutting down an operating electrolytic cell for the production of aluminium and having vertically displaceable anodes, the process comprising:

lowering the anodes until a bottom surface of the anodes is immersed in an aluminium layer of the electrolytic cell in a molten state;

allowing the aluminium layer and an electrolyte bath in a molten state to cool down with the bottom surface of the anodes immersed in the aluminium layer, the electrolyte bath covering the aluminium layer;

determining if the electrolyte bath is solidified, if the electrolyte bath is solidified, raising the anodes before solidification of the aluminium layer to create a space between a bottom surface of the solidified electrolyte bath and the bottom surface of the anodes and a top surface of the aluminium layer.

13. A process as claimed in claim 12, wherein the cooling down step further comprises periodically moving up and down the anodes to break a peripheral crust of the electrolyte bath at a periphery of the electrolytic cell.

14. A process as claimed in claim 13, wherein the bottom surface of the anodes remains immersed in the aluminium layer during the periodically moving up and down step.

15. A process as claimed in claim 12, further comprising cutting of electrolysis electric power to the electrolytic cell after lowering the anodes.

16. A process as claimed in claim 15, wherein lowering the anodes is performed within one hour of cutting electrolysis electric power to the electrolytic cell.

17. A process as claimed in claim 12, wherein lowering the anodes comprises moving downwardly the anodes along a distance of approximately five to seven centimeters over a period of at least ten minutes.

18. A process as claimed in claim 12, wherein raising the anodes is performed after the aluminium layer has reached a temperature below approximately 825° C.

19. A process as claimed in claim 12, wherein determining if the electrolyte bath is solidified further comprises monitoring a temperature of the aluminium layer and wherein raising the anodes is performed after the temperature of the aluminium layer is below approximately 825° C.

20. A process as claimed in claim 12, wherein raising the anodes is performed before the aluminium layer reaches approximately 660° C.

21. A process for shutting down an operating electrolytic cell for the production of aluminium; the process comprising:

moving downwardly anodes of the electrolytic cell from an operating position where bottom surfaces of the anodes are immersed in an electrolytic bath in a molten state to a cooling position where the bottom surfaces of the anodes are immersed in an aluminium layer in a molten state, the aluminium layer being covered by the electrolytic bath;

allowing the electrolytic cell to cool and periodically moving up and down the anodes with the bottom surfaces of the anodes remaining in the aluminium layer to break a peripheral crust of the electrolytic bath forming at a periphery of the electrolytic cell;

monitoring a state of the electrolytic bath;

after the electrolytic bath has completely solidified into a cohesive mass, raising the anodes to create a space between a bottom surface of the electrolytic bath in a solid state and a top surface of the aluminium layer in the molten state; and allowing the electrolytic cell to cool until the aluminium layer solidifies.

22. A process as claimed in claim 21, further comprising cutting of electrolysis electric power to the electrolytic cell after moving downwardly the anodes.

23. A process as claimed in claim 22, wherein moving downwardly the anodes is performed within one hour of cutting electrolysis electric power to the electrolytic cell.

24. A process as claimed in claim 21, wherein the bottom surface of the anodes is located above the top surface of the aluminium layer after raising the anodes and during cooling of the electrolytic cell.

25. A process of restarting an electrolytic cell for the production of aluminium, the electrolytic cell having a solidified aluminium layer, an electrolytic bath solidified around anodes and spaced apart from the aluminium layer by a seven to twelve centimeter anode-cathode distance separating an bottom surface of the anodes from a top surface of the solidified aluminium layer; the process comprising:

adding molten electrolytic bath to the electrolytic cell and into a space defined between the solidified electrolytic bath and the solidified aluminium layer;

applying electrolysis electric power to the electrolytic cell following addition of molten electrolytic bath to the electrolytic cell;

then, adding additional molten electrolytic bath to the electrolytic cell and simultaneously raising the anodes until the anode-cathode distance is between seventeen and twenty centimeters.

26. A process according to claim 25, further comprising maintaining the anode-cathode distance between 17 to 20 cm until the previously solidified aluminium layer metal has completely melted; and then siphoning excess electrolytic bath from the electrolytic cell and restoring the anode-cathode distance to an operating position.

* * * * *